US008793955B2

(12) United States Patent
Ray et al.

(10) Patent No.: US 8,793,955 B2
(45) Date of Patent: Aug. 5, 2014

(54) MULTI-LAYERED SHINGLE

(75) Inventors: Brian R. Ray, Whitehouse, OH (US); Lawrence J. Grubka, Westerville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 13/422,331

(22) Filed: Mar. 16, 2012

(65) Prior Publication Data

US 2013/0239506 A1 Sep. 19, 2013

(51) Int. Cl.
*E04D 1/00* (2006.01)

(52) U.S. Cl.
USPC ..... 52/528; 52/535; 52/557; 428/126

(58) Field of Classification Search
USPC ..... 52/553, 518, 527, 535, 557, 528, 554, 52/748.1, DIG. 16, 540, 559; D25/139; 428/124, 126
See application file for complete search history.

(56) References Cited

U.S. PATENT DOCUMENTS

| | | | | | |
|---|---|---|---|---|---|
| 1,597,135 | A | * | 8/1926 | Wittenberg | 52/559 |
| 1,698,891 | A | * | 1/1929 | Overbury | 29/412 |
| 1,795,913 | A | * | 3/1931 | Weaver | 52/420 |
| 1,819,717 | A | | 8/1931 | Mangano | |
| 3,613,328 | A | * | 10/1971 | Morgan et al. | 52/555 |
| 3,894,376 | A | * | 7/1975 | Shearer | 52/518 |
| 3,913,294 | A | * | 10/1975 | Freiborg | 52/518 |
| 4,322,928 | A | | 4/1982 | Freiborg | |
| 4,434,589 | A | * | 3/1984 | Freiborg | 52/57 |
| 4,672,790 | A | * | 6/1987 | Freiborg | 52/521 |
| 5,094,042 | A | * | 3/1992 | Freborg | 52/57 |
| 5,247,771 | A | * | 9/1993 | Poplin | 52/518 |
| 5,471,801 | A | * | 12/1995 | Kupczyk et al. | 52/57 |
| D379,672 | S | | 6/1997 | Lamb et al. | |
| D415,848 | S | | 10/1999 | Plath et al. | |
| 6,510,664 | B2 | * | 1/2003 | Kupczyk | 52/528 |
| 6,709,994 | B2 | | 3/2004 | Miller et al. | |
| 6,748,714 | B2 | | 6/2004 | Elliott | |
| D644,753 | S | | 9/2011 | Elliott | |
| 2002/0189189 | A1 | | 12/2002 | Kupczyk | |
| 2004/0055240 | A1 | * | 3/2004 | Kiik et al. | 52/545 |
| 2004/0083672 | A1 | | 5/2004 | Penner | |
| 2004/0103611 | A1 | | 6/2004 | King et al. | |
| 2004/0123545 | A1 | * | 7/2004 | Phillips | 52/535 |
| 2005/0055902 | A1 | * | 3/2005 | Pressutti et al. | 52/198 |
| 2006/0201094 | A1 | * | 9/2006 | Lassiter | 52/518 |
| 2009/0229210 | A1 | | 9/2009 | Binkley et al. | |

OTHER PUBLICATIONS

Notice of Allowance from U.S. Appl. No. 29/416,001 dated Jun. 9, 2013.

* cited by examiner

*Primary Examiner* — Robert Canfield
*Assistant Examiner* — Babajide Demuren
(74) *Attorney, Agent, or Firm* — Calfee, Halter & Griswold LLP

(57) ABSTRACT

A multi-layered shingle includes an underlay sheet having a longitudinally extending axis and a leading edge. The underlay sheet further defines a first layer and a second layer. The second layer is connected to the first layer along a first longitudinally extending fold line and folded against the first layer. An overlay sheet is bonded to the underlay sheet, and the first and second layers of the underlay sheet define multiple layers of a multi-layered shingle.

20 Claims, 5 Drawing Sheets

MULTI-LAYERED SHINGLE

BACKGROUND OF THE INVENTION

Various embodiments of a roofing shingle are described herein. In particular, the embodiments described herein relate to an improved multi-layered roofing shingle for use on the roof of a building structure.

Asphalt-based roofing materials, such as roofing shingles, roll roofing and commercial roofing, are installed on the roofs of buildings to provide protection from the elements and to give the roof an aesthetically pleasing appearance. Typically, the roofing material is constructed of a substrate such as a glass fiber mat or an organic felt, an asphalt coating on the substrate, and a protective and/or decorative surface layer of granules of stone, mineral, sand or other particulate material is embedded in the tacky asphalt coating.

It is well known in the roofing industry that irregularity or variation in shingle design provides a roof that is aesthetically pleasing and in popular demand. Mass produced asphalt roofing shingles of the ordinary three-tab variety, when placed on the roof, result in a roof that sometimes appears flat, dimensionless, and uninteresting. Shingle manufacturers have attempted to provide an improved appearance to such roofs by using variations in the thickness and in the tab cutout design of shingles. The goal is to produce a random looking sequence or pattern of shingles on the roof, similar to the appearance given by a roof shingled with wood shingles having varying widths, lengths, and thicknesses.

Thus, it would be desirable to provide an improved multi-layered roofing shingle for use on the roof of a building structure that addresses the issues discussed above.

SUMMARY OF THE INVENTION

The present application describes various embodiments of a multi-layered shingle. One embodiment of the multi-layered shingle includes an underlay sheet having a longitudinally extending axis and a leading edge. The underlay sheet further defines a first layer and a second layer. The second layer is connected to the first layer along a first longitudinally extending fold line and folded against the first layer. An overlay sheet is bonded to the underlay sheet, and the first and second layers of the underlay sheet define multiple layers of a multi-layered shingle.

In a second embodiment, a multi-layered shingle includes a shingle substrate having a longitudinally extending axis and a leading edge. The underlay sheet further defines a first layer and a second layer. The second layer is connected to the first layer along a first longitudinally extending fold line and folded against the first layer. The first and second layers of the shingle substrate define multiple layers of a multi-layered shingle.

In a third embodiment, a method of forming a multi-layered shingle includes forming a first longitudinally extending fold line in a shingle substrate having a longitudinally extending axis, wherein the first longitudinally extending fold line divides the shingle substrate into a first portion and a second portion. The shingle substrate is folded along the first longitudinally extending fold line such that the second portion is folded against the first portion, thereby defining first and second layers of a multi-layered shingle.

Other advantages of the multi-layered shingle will become apparent to those skilled in the art from the following detailed description, when read in view of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Referring now to FIGS. 1 through 5, a first embodiment of a multi-layered shingle in accordance with the invention is shown at 10. The multi-layered shingle 10 is a laminated shingle and may be formed by any desired method, such as disclosed in commonly assigned U.S. Pat. No. 6,709,994 to Miller et al. and U.S. Pat. No. 6,748,714 to Elliot, both of which are incorporated by reference—in their entireties. As described in detail below, the shingle of the invention may also be a non-laminated shingle, such as a three-tab shingle.

Figure 1:
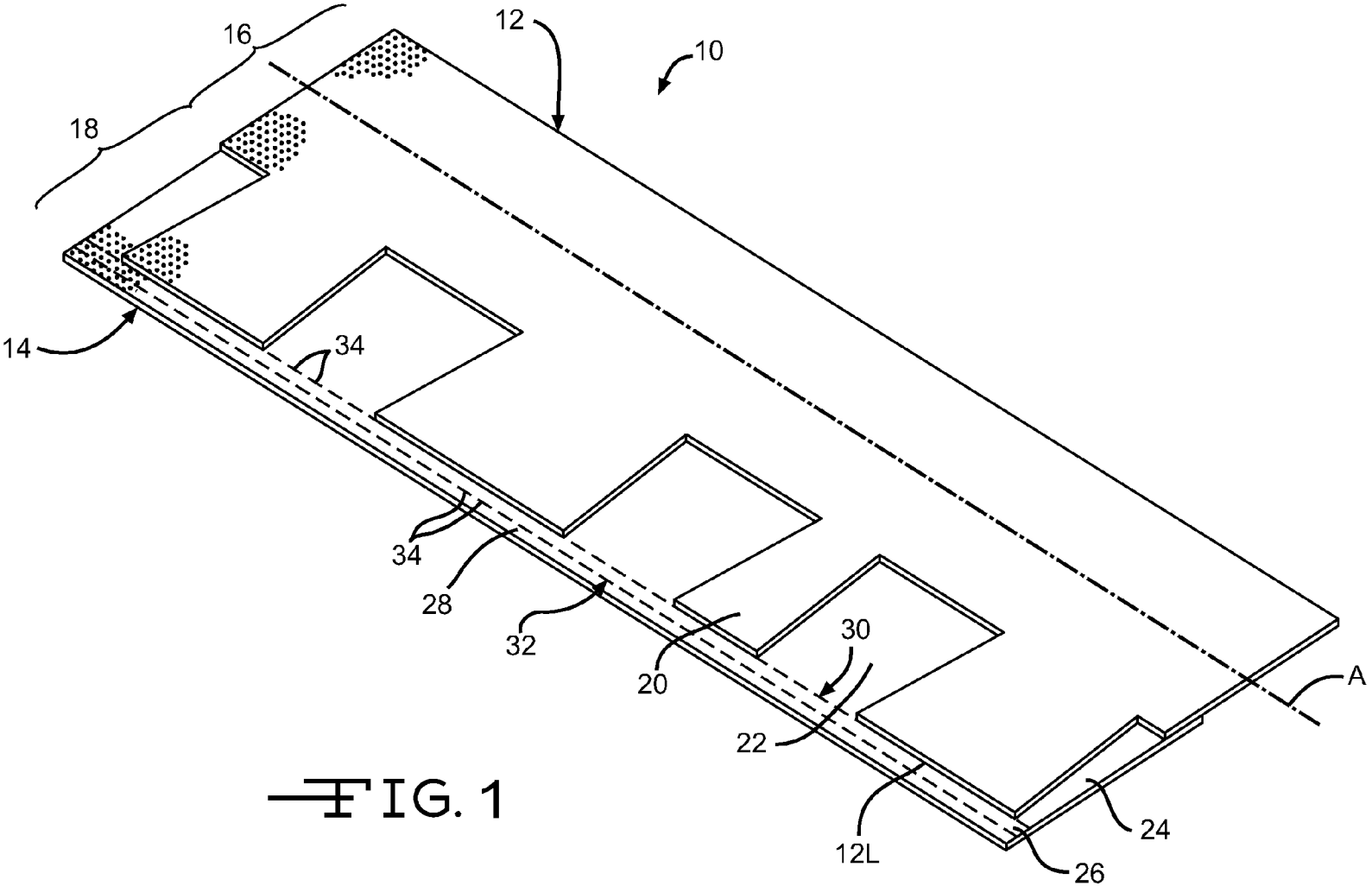
FIG. 1 is a perspective view of a first embodiment of a multi-layered shingle in accordance with this invention.

In FIG. 1, the shingle 10 is shown prior to folding in an unfolded or pre-folded position. The shingle 10 has a longitudinal axis A and includes an overlay sheet 12 fixed to an underlay sheet 14. The overlay sheet 12 includes a headlap portion 16 and a tab portion 18. In the illustrated embodiment, the tab portion 18 includes five tabs 20 separated by cutouts 22. Alternatively, any suitable number of tabs 20 and cutouts may be formed in the tab portion 18. The headlap portion 16 and the tabs 20 may include one or more granule patterns thereon. Edges of the tabs 20 define a leading edge 12L of the overlay sheet 12.

Figure 2:
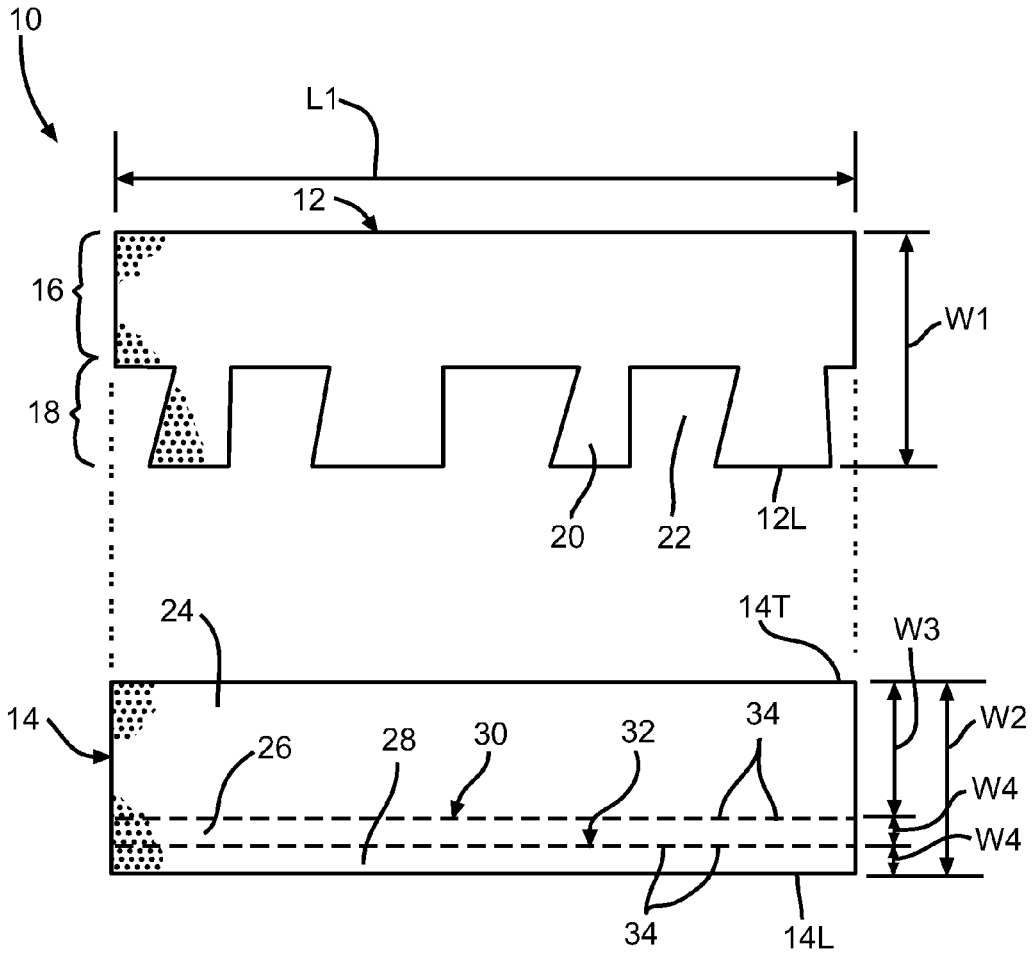
FIG. 2 is an exploded top plan view of the multi-layered shingle in illustrated in FIG. 1.

Referring to FIG. 2, the overlay sheet 12 may have any suitable dimensions. For example, illustrated overlay sheet 12, and the assembled and folded shingle 10, has a length L1 of about 36 inches (91.5 cm) and a width W1 of about 12 inches (30.5 cm). Alternatively, the overlay sheet 12 may have a length L1 within the range of from about 24.0 inches (60.96 cm) to about 39⅜ inches (100.01 cm), and a width W1 within the range of from about 7.0 inches (17.78 cm) to about 14.0 inches (35.56 cm).

In the unfolded position as shown in FIG. 1, the underlay sheet 14 includes a leading edge 14L and a trailing edge 14T. In FIG. 1, the underlay sheet 14 is shown at an intermediate stage of manufacture that will be folded as described below. The underlay sheet 14 has the length L1 of about 40 inches (101.6 cm). Alternatively, the underlay sheet 14 may have a length L1 within the range of from about 35 inches (88.9 cm) to about 45 inches (114.3 cm). Additionally, the underlay sheet 14 may have a length L1 within the range of from about 32 inches (81.3 cm) to about 50 inches (127 cm). The underlay sheet 14 may also have a length L1 within the range of from about 30 inches (76.2 cm) to about 55 inches (139.7 cm). Prior to folding, the underlay sheet 14 has an overall width W2 of about 8⅝ inches (21.9 cm). Alternatively, the underlay sheet 14 may have a width W2 within the range of from about 8 inches (20.3 cm) to about 12 inches (30.5 cm). Additionally, the underlay sheet 14 may have a width W2 within the range of from about 6 inches (15.2 cm) to about 13 inches (33 cm). The underlay sheet 14 may also have a width W2 within the range of from about 5 inches (12.7 cm) to about 15 inches (38.1 cm).

The underlay sheet 14 includes a first underlay portion 24, a second underlay portion 26 and a third underlay portion 28. A first longitudinally extending fold line 30 and a second longitudinally extending fold line 32 extend along the length of the underlay sheet. The first longitudinally extending fold line 30 separates a first underlay portion 24 and the second underlay portion 26, and the second longitudinally extending fold line 32 separates the a second underlay portion 26 and the third underlay portion 28. In the illustrated embodiment, the first and second longitudinally extending fold lines 30 and 32 are substantially parallel with the leading edge 14L of the underlay sheet 14. Alternatively, the first and second longitudinally extending fold lines 30 and 32 may be formed such that they are not parallel with the leading edge 14L or with each other.

The first underlay portion 24 has a width W3 of about 6⅝ inches (16.8 cm). Alternatively, the first underlay portion 24 may have a width W3 within the range of from about 6.5 inches (16.5 cm) to about 12 inches (30.5 cm). Additionally, the underlay sheet 14 may have a width W3 within the range of from about 6 inches (15.2 cm) to about 13 inches (33 cm). The underlay sheet 14 may also have a width W3 within the range of from about 5 inches (12.7 cm) to about 15 inches (38.1 cm). The second underlay portion 26 and the third underlay portion 28 each have a width W4 of about 1.0 inches (2.5 cm). Alternatively, the second and third underlay portions 26 and 28 may have a width W4 within the range of from about 0.25 inches (0.6 cm) to about the width W3 of the first underlay portion 24.

The fold lines 30 and 32 illustrated in FIG. 1 may be formed by any desired method, including perforations, score lines, depressions, and/or indentations configured such that the underlay sheet 14 may be folded along the first and second longitudinally extending fold lines 30 and 32 as described below.

In the embodiment of the underlay sheet 14 illustrated in FIG. 1, the fold lines 30 and 32 are formed as perforated cut lines and include spaced apart perforations 34. In the illustrated embodiment, the perforations 34 extend through entire thickness of the underlay sheet 14. The perforations 34 may be arranged in any suitable pattern to form the perforated fold lines 30 and 32. In one embodiment of a perforation pattern of the perforated fold lines 30 and 32, the perforations 34 may be about 0.25 inches (0.64 cm) long and spaced apart from end to end by about 0.25 inches (0.64 cm). In another embodiment of a perforation pattern, the perforations 34 may be about 0.50 inches (1.27 cm) long and spaced apart from end to end about 0.50 inches (1.27 cm). Alternatively, the perforations 34 may have any desired length and may be spaced apart end to end by any desired length.

The fold lines 30 and 32 illustrated in FIGS. 1 and 2 may be alternatively formed as deep depressions and/or indentations that may not extend through the entire thickness of the underlay sheet 14. These deep depressions and/or indentations may be discontinuous, as illustrated in FIG. 1, or may be continuous and extend longitudinally across any desired length of the underlay sheet 14. It will be further understood that these deep depressions and/or indentations will be formed having any suitable depth deep enough such that the underlay sheet 14 may be folded along the first and second longitudinally extending fold lines 30 and 32 as described below.

Figure 3:
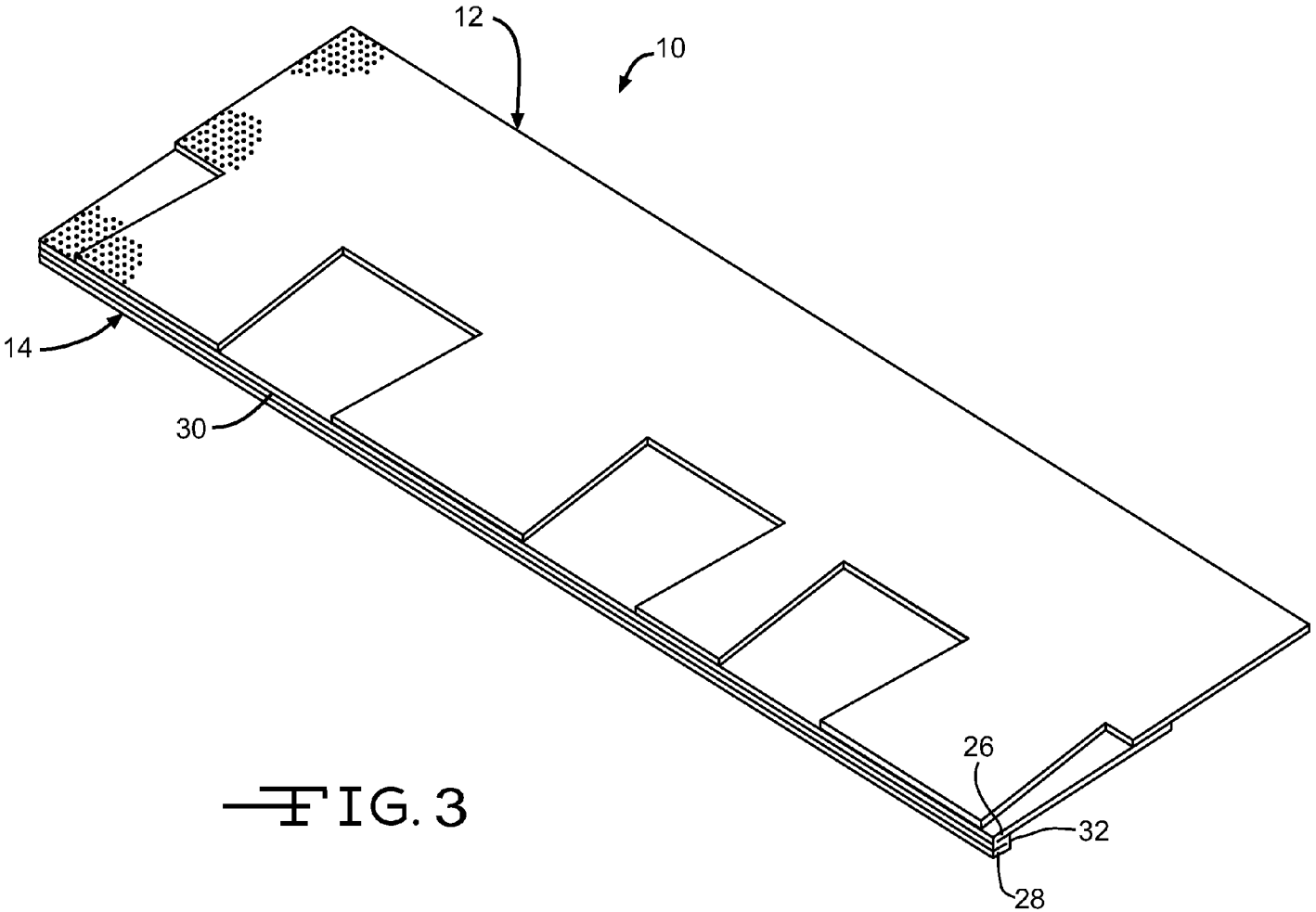
FIG. 3 is a perspective view of the shingle illustrated in FIG. 1, showing the shingle in an assembled and folded position.
Figure 4:
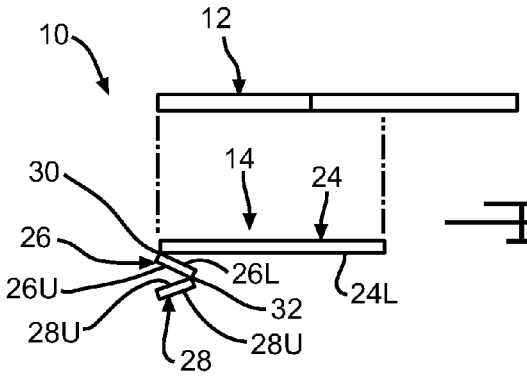
FIG. 4 is an exploded side view of the shingle illustrated in FIG. 1, showing the underlay sheet partially folded.
Figure 5:
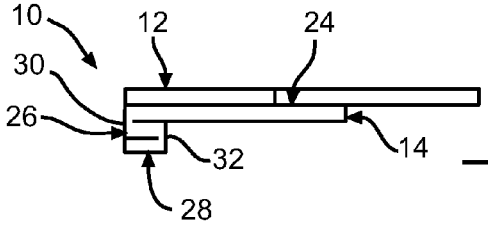
FIG. 5 is a side view of the shingle illustrated in FIGS. 3 and 4.

FIG. 4 illustrates the multi-layered shingle 10 at an intermediate stage of manufacture and FIGS. 3 and 5 illustrate the multi-layered shingle 10 in a fully assembled and folded position. As shown in FIGS. 4 and 5, the multi-layered shingle 10 may be formed by folding the underlay sheet 14 along the first and second longitudinally extending fold lines 30 and 32 such that a first surface 26L of the second underlay portion 26 is moved into engagement with a first surface 24L of the first underlay portion 24, and a second surface 28U of the third underlay portion 28 is moved into engagement with a second surface 26U of the second underlay portion 26. It will be understood that once the underlay sheet 14 is folded, the second surface 26U of the second underlay portion 26 and the second surface 28U of the third underlay portion 28 will be facing downwardly as shown in FIG. 4, and therefore define lower surfaces.

The first and second longitudinally extending fold lines 30 and 32 may be formed in the underlay sheet 14 during the shingle manufacturing process. The underlay sheet 14 may also be folded along the first and second longitudinally extending fold lines 30 and 32 during the shingle manufacturing process. Alternatively, the sheet 14 may be folded along the first and second longitudinally extending fold lines 30 and 32 off line during a secondary manufacturing process, or by hand. In one embodiment, the underlay sheet 14 is compressed after being folded to ensure that the second and third underlay portions 26 and 28 remain in the folded position. If desired, adhesive (not shown) may be applied between the first underlay portion 24 and the second underlay portion 26, and between the second underlay portion 26 and the third underlay portion 28.

Figure 6:
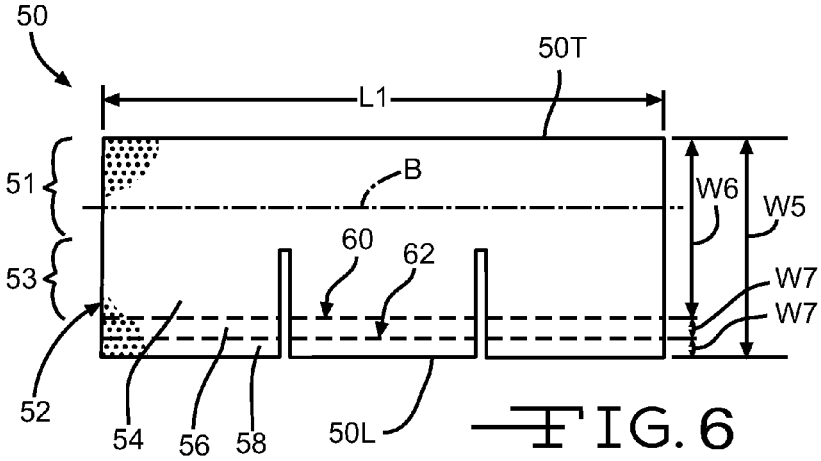
FIG. 6 is a top plan view of a second embodiment of a multi-layered shingle in accordance with this invention.
Figure 7:
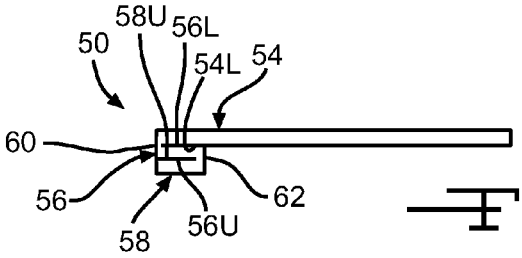
FIG. 7 is a side view of the shingle illustrated in FIG. 6.

The multi-layered shingle of the invention may also be embodied as non-laminated shingle, such as a three-tab shingle 50 as illustrated in FIGS. 6 and 7. The second embodiment of the shingle 50 illustrated in FIGS. 6 and 7 is a single layer three-tab shingle having a headlap portion 51 and a tab portion 53. The tab portion 53 includes three tabs 52. Alternatively, the shingle 50 may have any desired number of tabs. The shingle 50 has a longitudinal axis B. An upper surface of the shingle 50 may include one or more granule patterns thereon. FIG. 6 shows the shingle 50 in an unfolded or pre-folded position. In the unfolded position, the shingle 50 includes a leading edge 50L.

The shingle 50 may have any suitable dimensions. For example, illustrated shingle 50 has the length L1 as described below. The illustrated shingle 50 is shown at an intermediate stage of manufacture that will be folded as described above. Prior to folding, the shingle 50 has the overall width W5 of about 36 inches (91.4 cm). Alternatively, the shingle 50 may have a width W5 within the range of from about 32 inches (81.3 cm) to about 40 inches (101.6 cm). Additionally, the shingle 50 may have a width W5 within the range of from about 30 inches (76.2 cm) to about 45 inches (114.3 cm). The shingle 50 may also have a width W5 within the range of from about 24 inches (61 cm) to about 50 inches (127 cm).

The tabs 52 include a first portion 54, a second portion 56, and a third portion 58. A first longitudinally extending fold line 60 and a second longitudinally extending fold line 62 extend longitudinally along the length of each tab 52. The first longitudinally extending fold line 60 separates the first portion 54 and the second portion 56, and the second longitudinally extending fold line 62 separates the second portion 56 and the third portion 58.

In the illustrated embodiment, the first and second longitudinally extending fold lines 60 and 62 are substantially parallel with the leading edge 50L of the shingle 50. Alternatively, the first and second longitudinally extending fold lines 60 and 62 may be formed such that they are not parallel with the leading edge 50L or with each other.

The shingle 50, as measured from the first longitudinally extending fold line 60 to a trailing edge 50T of the shingle 50 has a width W6 of about 12 inches (30.5 cm). Alternatively, the shingle 50 may have a width W6 within the range of from about 7.0 inches (17.78 cm) to about 14.0 inches (35.56 cm). The second portion 56 and the third portion 58 each have a width W7 of about 1.0 inches (2.5 cm). Alternatively, the second and third portions 56 and 58 may have a width W7 within the range of from about 0.25 inches (0.6 cm) to about a width W6 of the shingle 50.

The second underlay portion 26 and the third underlay portion 28 each have a width W4 of about 1.0 inches (2.5 cm). Alternatively, the second and third underlay portions 26 and 28 may have a width W4 within the range of from about 0.25 inches (0.6 cm) to about the width W3 of the first underlay portion 24.

The fold lines 60 and 62 illustrated in FIG. 6 may be formed by any desired method, including perforations, score lines, depressions, and/or indentations as described above and configured such that the shingle 50 may be folded along the first and second longitudinally extending fold lines 60 and 62 as also described above.

The multi-layered shingle 50 may be formed, as shown in FIG. 7, by folding the shingle 50 along the first and second longitudinally extending fold lines 60 and 62 such that a lower surface 56L of the second portion 56 is moved into engagement with a lower surface 54L of the first portion 54, and an upper surface 58U of the third portion 58 is moved into engagement with an upper surface 56U of the second portion 56. Once folded, the first portion 54 defines a first layer, the second portion 56 defines a second layer, and the third portion 58 defines a third layer of the multi-layered shingle 50.

As described above, the first and second longitudinally extending fold lines 60 and 62 may be formed in the shingle 50 during the shingle manufacturing process. The shingle 50 may also be folded along the first and second longitudinally extending fold lines 60 and 62 during the shingle manufacturing process. Alternatively, the shingle 50 may be folded along the first and second longitudinally extending fold lines 60 and 62 off line during a secondary manufacturing process, or by hand. In one embodiment, the shingle 50 is compressed after being folded to ensure that the second and third portions 56 and 58 remain in the folded position. If desired, adhesive may be applied between the first portion 54 and the second portion 56, and between the second portion 56 and the third portion 58.

Figure 8:
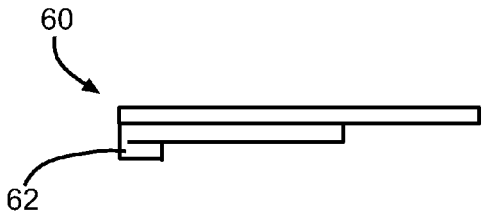
FIG. 8 is a side view of a third embodiment of a multi-layered shingle in accordance with this invention.
Figure 9:
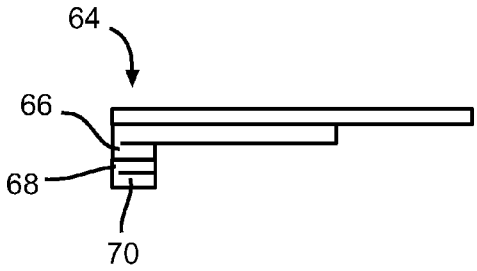
FIG. 9 is a side view of a fourth embodiment of a multi-layered shingle in accordance with this invention.

It will be understood that a multi-layered shingle manufactured in accordance with this invention may have only one folded layer 62, as shown in the third embodiment of the shingle 60 in FIG. 8. Additionally, a multi-layered shingle manufactured in accordance with this invention may have more than two folded layers, such as the layers 66, 68, and 70, as shown in the fourth embodiment of the shingle 64 in FIG. 9. It will be understood that the multi-layered shingle of the invention may have any desired number of folded layers, including four or more folded layers.

The principle and mode of operation of the multi-layered shingle have been described in its preferred embodiments. However, it should be noted that the multi-layered shingle described herein may be practiced otherwise than as specifically illustrated and described without departing from its scope.

What is claimed is:

1. A multi-layered shingle comprising:

an underlay sheet having a longitudinally extending axis, the underlay sheet having a leading edge and defining a first layer and a second layer, the second layer connected to the first layer along a first longitudinally extending fold line and folded against a bottom surface of the first layer, the first longitudinally extending fold line extending along an entire length of the shingle; and an overlay sheet bonded to a top surface of the first layer of the underlay sheet, the overlay sheet including a plurality of tabs separated by cutouts, the tabs extending toward the first longitudinally extending fold line of the underlay sheet, each of the plurality of tabs including a leading edge that aligns with the first longitudinally extending fold line of the underlay sheet.

2. The multi-layered shingle according to claim 1, wherein the underlay sheet further defines a third layer connected to the second layer along a second longitudinally extending fold line.

3. The multi-layered shingle according to claim 1, wherein the underlay sheet is substantially rectangular in shape when in an unfolded condition.

4. The multi-layered shingle according to claim 1, wherein the first longitudinally extending fold line is defined by perforations formed in the underlay sheet, the perforations structured and configured to facilitate folding of the underlay sheet along the first longitudinally extending fold line.

5. The multi-layered shingle according to claim 1, wherein the first longitudinally extending fold line is defined by one of a longitudinally extending depression and a longitudinally extending indentation formed in the underlay sheet, the one of a longitudinally extending depression and a longitudinally extending indentation structured and configured to facilitate folding of the underlay sheet along the first longitudinally extending fold line.

6. The multi-layered shingle according to claim 2, wherein the first and second longitudinally extending fold lines are defined by perforations formed in the underlay sheet, the perforations structured and configured to facilitate folding of the underlay sheet along the first and second longitudinally extending fold lines.

7. The multi-layered shingle according to claim 2, wherein the first and second longitudinally extending fold lines extend substantially longitudinally across the underlay sheet and are substantially parallel with the leading edge of the underlay sheet.

8. The multi-layered shingle according to claim 2, wherein the first and second longitudinally extending fold lines are defined by one of a longitudinally extending depression and a longitudinally extending indentation formed in the underlay sheet, the one of a longitudinally extending depression and a longitudinally extending indentation structured and configured to facilitate folding of the underlay sheet along the first and second longitudinally extending fold lines.

9. A multi-layered shingle having a headlap portion, a tab portion, and a longitudinally extending axis, the shingle comprising:

a shingle substrate having a first upper layer having a rear portion extending into the headlap portion and a front portion defining a leading edge of the tab portion, a second middle layer connected to the front portion of the first layer along a first longitudinally extending fold line and folded against a bottom surface of the first layer, and a third layer connected to the second layer along a second longitudinally extending fold line, the third layer folded against a bottom surface of the folded second layer.

10. The multi-layered shingle according to claim 9, wherein the shingle substrate is substantially rectangular in shape when in an unfolded condition.

11. The multi-layered shingle according to claim 9, wherein the first and second longitudinally extending fold lines are defined by perforations formed in the shingle substrate, the perforations structured and configured to facilitate folding of the shingle substrate along the first and second longitudinally extending fold lines.

12. The multi-layered shingle according to claim 9, wherein the first and second longitudinally extending fold lines extend substantially longitudinally across the shingle substrate and are substantially parallel with the leading edge.

13. The multi-layered shingle according to claim 9, wherein the first and second longitudinally extending fold lines are defined by one of longitudinally extending depressions and longitudinally extending indentations formed in the shingle substrate, the one of the longitudinally extending depressions and the longitudinally extending indentations structured and configured to facilitate folding of the shingle substrate along the first and second longitudinally extending fold lines.

14. The multi-layered shingle according to claim 1, wherein a leading edge of the overlay sheet aligns with the first longitudinally extending fold line of the underlay sheet.

15. The multi-layered shingle of claim 9, wherein the tab portion of the shingle substrate includes a plurality of tabs spaced apart by cutouts.

16. The multi-layered shingle of claim 9, further comprising an overlay sheet bonded to the shingle substrate.

17. The multi-layered shingle of claim 16, wherein a leading edge of the overlay sheet aligns with the first longitudinally extending fold line of the underlay sheet.

18. The multi-layered shingle of claim 16, wherein the overlay sheet includes a plurality of tabs separated by cutouts, the tabs overlying the tab portion of the shingle substrate.

19. A multi-layered shingle comprising:

an underlay sheet having a longitudinally extending leading edge, a longitudinally extending trailing edge, and a first longitudinally extending fold line parallel with and disposed between the leading edge and the trailing edge, the first fold line being formed from at least one of perforations, score lines, depressions, and indentations, with a first portion of the underlay sheet extending from the trailing edge to the first fold line and a second portion of the underlay sheet being disposed between the first fold line and the leading edge; and an overlay sheet bonded to a top surface of the first portion of the underlay sheet, the overlay sheet including a plurality of tabs separated by cutouts, the tabs extending toward the first longitudinally extending fold line of the underlay sheet, each of the plurality of tabs including a leading edge that aligns with the first fold line of the underlay sheet.

20. The multi-layered shingle of claim 19, wherein the underlay sheet further includes a second longitudinally extending fold line parallel with and disposed between the leading edge and the first fold line, the second fold line being formed from at least one of perforations, score lines, depressions, and indentations, with the second portion of the underlay sheet extending from the first fold line to the second fold line, and a third portion of the underlay sheet extending from the second fold line to the leading edge of the underlay sheet.

* * * * *